US007448472B2

(12) United States Patent
Kugiya et al.

(10) Patent No.: US 7,448,472 B2
(45) Date of Patent: Nov. 11, 2008

(54) ELEVATOR APPARATUS THAT DETECTS AN ACCURATE RUNNING SPEED OF AN ELEVATOR CAR THAT OPERATES OVER SPEED

(75) Inventors: Takuo Kugiya, Tokyo (JP); Takaharu Ueda, Tokyo (JP); Ken-Ichi Okamoto, Tokyo (JP); Tatsuo Matsuoka, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 574 days.

(21) Appl. No.: 10/538,307

(22) PCT Filed: Nov. 21, 2003

(86) PCT No.: PCT/JP03/14923

§ 371 (c)(1),
(2), (4) Date: Jun. 9, 2005

(87) PCT Pub. No.: WO2005/049468

PCT Pub. Date: Jun. 2, 2005

(65) Prior Publication Data

US 2006/0124399 A1 Jun. 15, 2006

(51) Int. Cl.
*B66B 5/04* (2006.01)

(52) U.S. Cl. ..... 187/305; 187/287; 187/288

(58) Field of Classification Search ..... 187/276, 187/277, 281, 286, 287, 288, 289, 293, 296, 187/302, 305

See application file for complete search history.

(56) References Cited

U.S. PATENT DOCUMENTS 4,155,426 A * 5/1979 Booker, Jr. ..... 187/295
5,229,558 A * 7/1993 Hakala ..... 187/293
5,780,786 A * 7/1998 Miyanishi ..... 187/293
5,984,052 A * 11/1999 Cloux et al. ..... 187/404
7,228,943 B2 * 6/2007 Kugiya et al. ..... 187/393
2004/0200671 A1 10/2004 Kugiya et al.

FOREIGN PATENT DOCUMENTS

JP 53-107049 9/1978
JP 58-22283 2/1983

(Continued)

OTHER PUBLICATIONS

Chinese Office Action dated Feb. 22, 2008.

*Primary Examiner*—Jonathan Salata
(74) *Attorney, Agent, or Firm*—Buchanan Ingersoll & Rooney PC

(57) ABSTRACT

In an elevator apparatus, a car ascends and descends based on a running speed pattern generated by a control panel. Destination floor buttons and landing buttons are connected to an over speed monitoring portion without the intervention of the control panel. The over speed monitoring portion has an over speed setting portion for setting first and second over speeds based on car position information obtained from a car position detector and call registration information obtained from the destination floor buttons and the landing buttons. In the over speed setting portion, a running speed pattern different from the running speed pattern generated by the control panel is independently generated without depending on information from the control panel. The first and second over speeds are set based on the running speed pattern generated by the over speed setting portion.

9 Claims, 15 Drawing Sheets

FOREIGN PATENT DOCUMENTS

| | | | |
|---|---|---|---|
| JP | 5-155553 | | 6/1993 |
| JP | 10-231080 | | 9/1998 |
| JP | 2003-104648 | | 4/2003 |
| JP | 2003-238037 | A | 8/2003 |
| WO | 03/004397 | A1 | 1/2003 |

* cited by examiner

ELEVATOR APPARATUS THAT DETECTS AN ACCURATE RUNNING SPEED OF AN ELEVATOR CAR THAT OPERATES OVER SPEED

TECHNICAL FIELD

The present invention relates to an elevator apparatus which has a function of setting an over speed and monitoring whether the running speed of a car reaches the over speed.

BACKGROUND ART

For example, in a conventional elevator apparatus disclosed in JP 2003-10468 A, a speed governor monitors whether the running speed of a car reaches an over speed. The speed governor sets, from car running speed pattern information and car call registration information, an over speed which should be judged as abnormal, and compares the actual car running speed and the set over speed.

However, in the conventional elevator apparatus, the speed governor obtains the car running speed pattern information and the car call registration information from a control panel. Therefore, when a runaway car is due to an abnormal control panel, information from the control panel can also be abnormal, and thus, there is a fear that the speed governor cannot detect the over speed or the speed governor unnecessarily actuates a braking device.

SUMMARY OF INVENTION

The present invention has been made to solve the above problem and therefore an object of the present invention is to obtain an elevator apparatus capable of detecting more accurately that the running speed of a car reaches an over speed.

To this end, according to one aspect of the present invention, there is provided an elevator apparatus including a car for ascending and descending in a hoistway. A controller controls the ascending and descending of the car. A car speed detector detects a running speed of the car and a car position detector detects a position of the car. An over speed monitoring portion receives information from the car speed detector and the car position detector, compares an over speed set correspondingly to the position of the car with the running speed of the car, and actuates brakes when the running speed of the car reaches the over speed. The over speed monitoring portion sets the over speed independently of the controller.

Further, according to another aspect of the present invention, there is provided an elevator apparatus including a car for ascending and descending in a hoistway. A car speed detector detects a running speed of the car and a load weighing device detects a weight of the car. An over speed monitoring portion receives information from the car speed detector, compares a set over speed with the running speed of the car, and actuates the brakes when the running speed of the car reaches the over speed. The over speed monitoring portion adjusts the over speed according to car weight information obtained from the load weighing device.

BEST MODE FOR CARRYING OUT THE INVENTION

Preferred embodiments of the present invention are described in the following with reference to the drawings.

Embodiment 1

Figure 1:
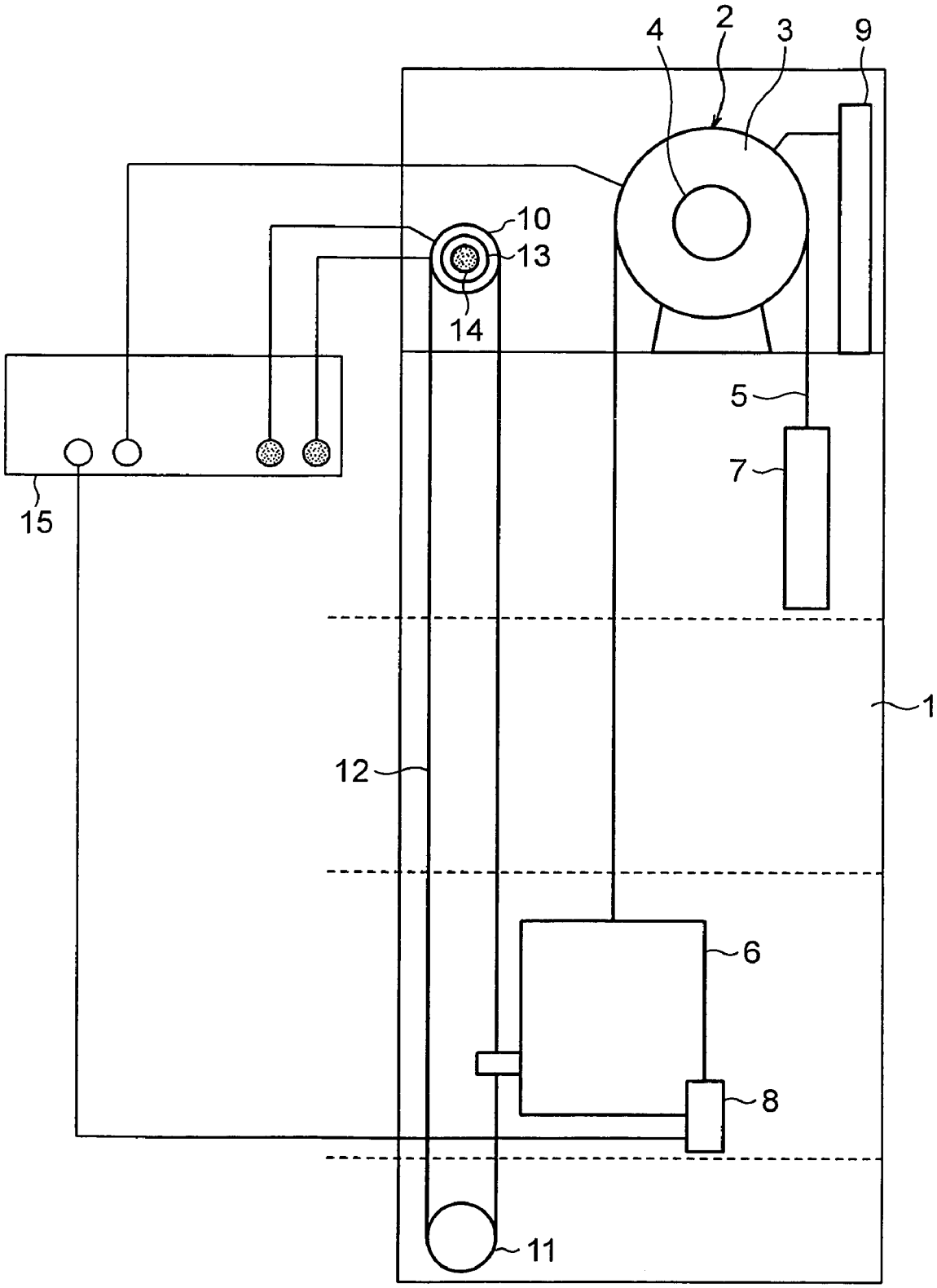
FIG. 1 is a structural diagram illustrating an elevator apparatus according to Embodiment 1 of the present invention.

FIG. 1 is a structural diagram illustrating an elevator apparatus according to Embodiment 1 of the present invention. In the figure, a driving device 2 is disposed in an upper portion of a hoistway 1. The driving device 2 has a driving sheave 3 and a braking device 4 as braking means for braking rotation of the driving sheave 3. A main rope 5 is stretched around the driving sheave 3.

A car 6 and a counterweight 7 are connected to the main rope 5 and thereby are hung in the hoistway 1. By rotating the driving sheave 3, the car 6 and the counterweight 7 ascend and descend in the hoistway 1. The car 6 has a safety device 8 mounted thereon as braking means for directly braking the car 6. The driving device 2 is controlled by a control panel 9 serving as a controller. The car 6 ascends and descends according to a running speed pattern (an operating speed target value) generated by the control panel 9.

An upper pulley 10 is disposed in the upper portion of the hoistway 1. A lower pulley 11 is disposed in a lower portion of the hoistway 1. A speed detection rope 12 is stretched around the upper pulley 10 and the lower pulley 11. Both ends of the speed detection rope 12 are connected to the car 6, by which the speed detection rope 12 is disposed like a loop.

When the car 6 ascends and descends, the upper pulley 10 and the lower pulley 11 rotate at a speed corresponding to the running speed of the car 6.

The upper pulley 10 is provided with a car speed detector 13 for detecting the running speed of the car 6 based on the rotation speed of the upper pulley 10 and a car position detector 14 for detecting the position of the car 6 based on the amount of rotation of the upper pulley 10.

Information from the car speed detector 13 and from the car position detector is inputted to an over speed monitoring portion 15. The over speed monitoring portion 15 sets first and second over speeds (over speed detection levels) which should be judged as abnormal. The first and second over speeds vary depending on the position of the car 6.

Also, the over speed monitoring portion 15 monitors the running speed of the car 6. When the running speed of the car 6 reaches the first over speed corresponding to the position of the car 6, the over speed monitoring portion 15 outputs an actuation command signal to the braking device 4, and indirectly brakes the car 6 using the braking device 4. Further, when the running speed of the car 6 reaches the second over speed corresponding to the position of the car 6, the over speed monitoring portion 15 outputs an actuation command signal to the safety device 8, and directly brakes the car 6.

Figure 2:
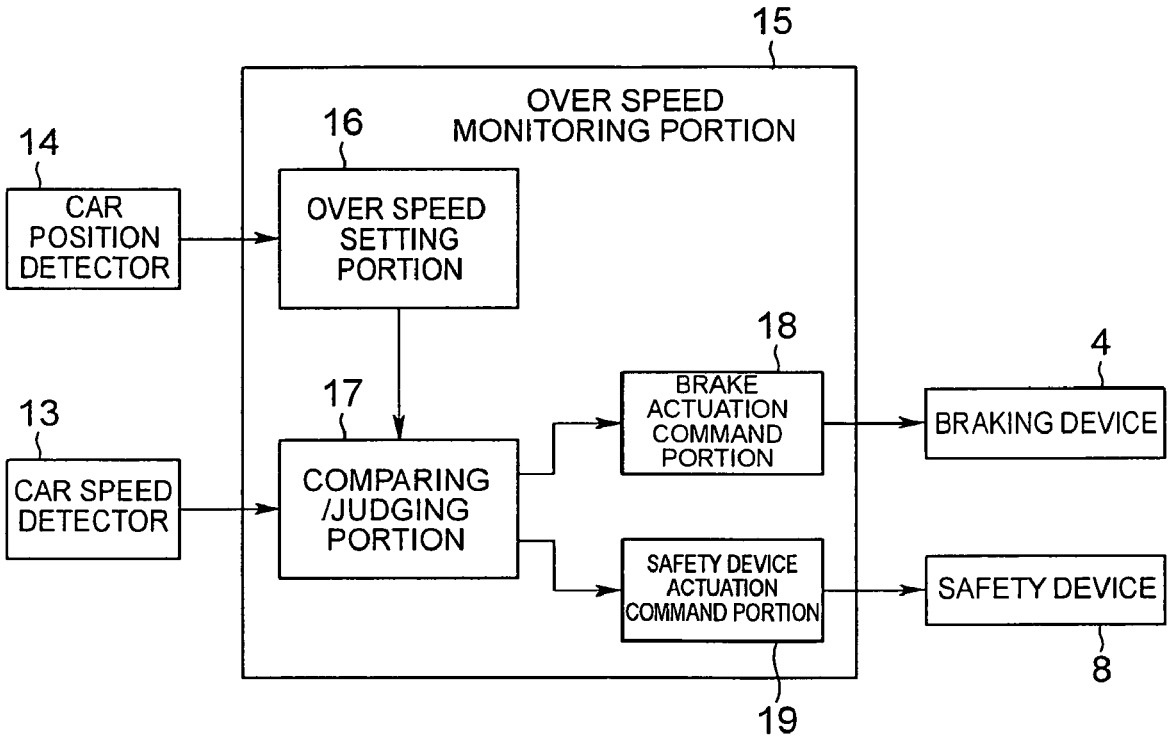
FIG. 2 is a block diagram illustrating main portions of FIG. 1.

FIG. 2 is a block diagram illustrating main portions of FIG. 1. In the figure, the over speed monitoring portion 15 has an over speed setting portion 16, a comparing/judging portion 17, a brake actuation command portion 18, and a safety device actuation command portion 19. The first and second over speeds are set by the over speed setting portion 16.

The comparing/judging portion 17 compares the first and second over speeds set by the over speed setting portion 16 with the running speed of the car 6 detected by the car speed detector 13 and judges whether there is an abnormality or not. The brake actuation command portion 18 outputs an actuation command signal to the braking device 4 based on a command from the comparing/judging portion 17. The safety device actuation command portion 19 outputs an actuation command signal to the safety device 8 based on a command from the comparing/judging portion 17.

Figure 3:
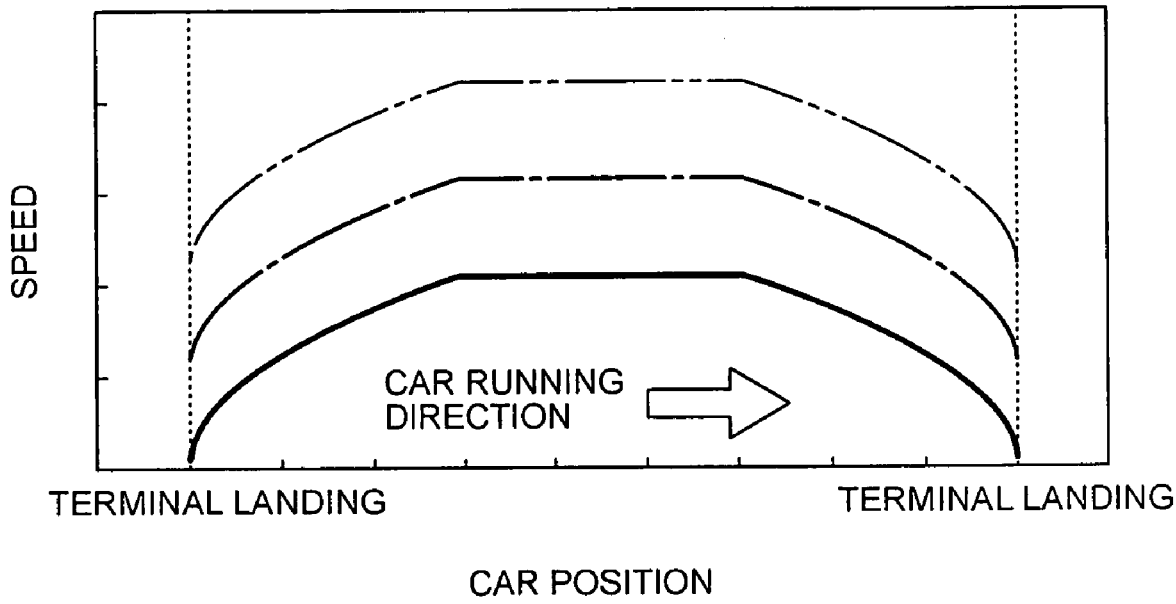
FIG. 3 is a graph illustrating a running speed pattern, a first over speed, and a second over speed obtained when the car shown in FIG. 1 runs normally from one terminal landing to the other terminal landing.

Next, a method of setting the first and second over speeds in the over speed setting portion 16 of Embodiment 1 is described. FIG. 3 is a graph illustrating the running speed pattern, the first over speed, and the second over speed obtained when the car 6 shown in FIG. 1 runs normally from one terminal landing to the other terminal landing.

In the figure, a solid line denotes the maximum values of the running speed pattern. An alternate-long-and-short-dashed line denotes the first over speed. Further, a chain-double-dashed line denotes the second over speed.

In the running speed pattern, an acceleration curve and a deceleration curve proximate to the terminal landings are determined using maximum values of acceleration (or deceleration) assumed proximately to the terminal landings. Further, the speed in a constant speed running region is the maximum value of speed assumed in the region. Therefore, when there is no abnormality, the running speed of the car 6 does not exceed the running speed pattern.

The first over speed is set as a pattern higher than the running speed pattern with a certain extent of margin between itself and the running speed pattern. The second over speed is set as a pattern higher than the first over speed with a certain extent of margin between itself and the first over speed. Therefore, the first and the second over speeds do not remain constant, and the first and the second over speeds proximate to the terminal landings are set to be lower than those of the other portion.

The over speed monitoring portion 15 is provided with storage means (a memory) and processing means (a CPU). The storage means stores the running speed pattern and the first and second over speed patterns as described in the above. The processing means determines the first and second over speeds corresponding to the car position information and compares the car speed information with the first and second over speeds.

In such an elevator apparatus, since the over speed monitoring portion 15 stores the first and the second over speed patterns set according to the position of the car 6, it is possible to judge whether there is an abnormality or not according to the position of the car 6 without depending on information from the control panel 9. Accordingly, even when the control panel 9 is out of order, it can be detected more accurately that the running speed of the car 6 reaches the first and second over speeds.

Further, since the first and second over speeds are set to be higher than the running speed pattern with a predetermined margin between themselves and the running speed pattern obtained when the car 6 runs normally from one terminal landing to the other terminal landing, the first and second over speeds proximate to the terminal landings are set to be lower than those of the other portion, and thus, an abnormality of the running speed can be detected at an earlier stage.

Embodiment 2

Figure 4:
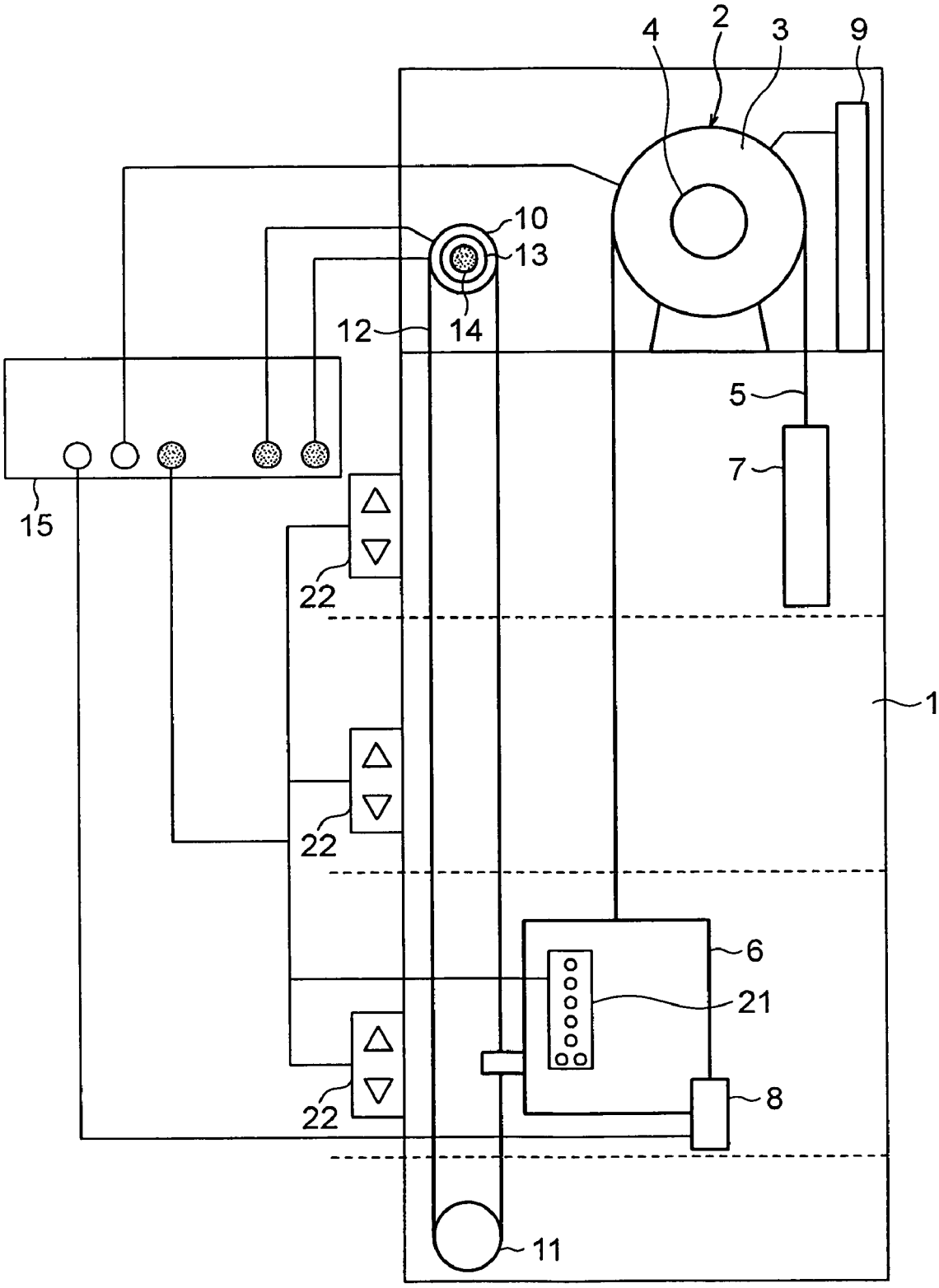
FIG. 4 is a structural diagram illustrating an elevator apparatus according to Embodiment 2 of the present invention.
Figure 5:
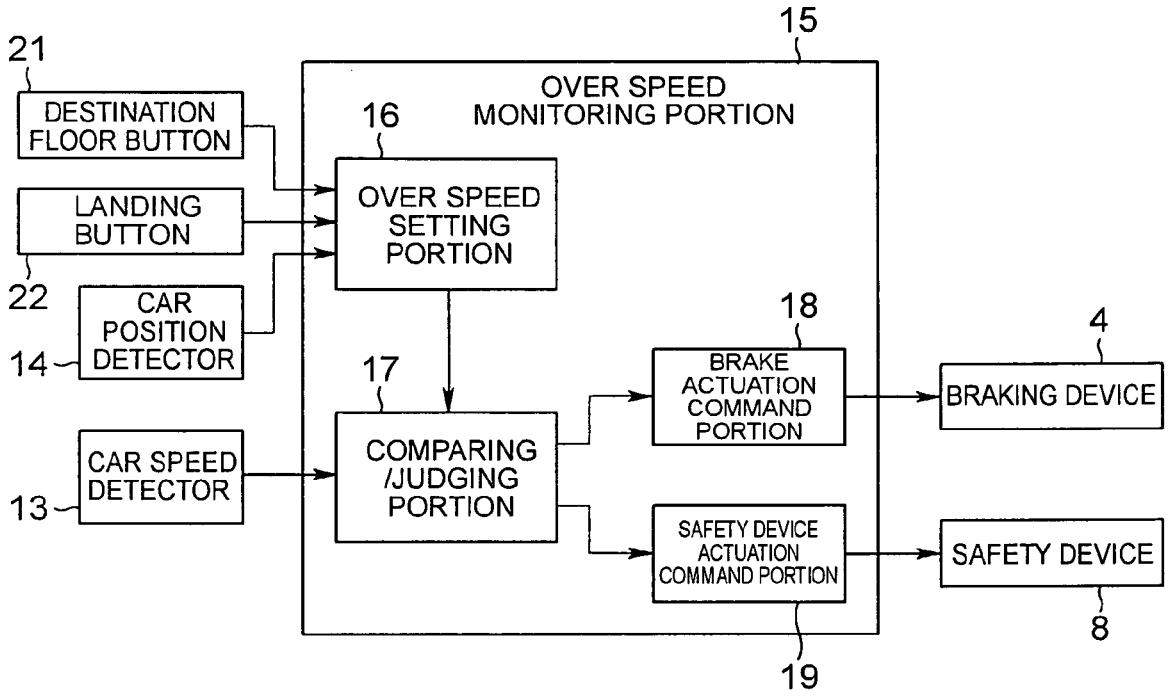
FIG. 5 is a block diagram illustrating main portions of FIG. 4.

Next, FIG. 4 is a structural diagram illustrating an elevator apparatus according to Embodiment 2 of the present invention, and FIG. 5 is a block diagram illustrating main portions of FIG. 4. In the figures, destination floor buttons 21 for registering a destination floor are provided to a car 6. Landings on respective floors are provided with landing buttons 22. By operating the destination floor buttons 21 or the landing buttons 22, a call is registered in a control panel 9, and the control panel 9 generates a running speed pattern of the car 6. The car 6 ascends and descends according to the running speed pattern generated by the control panel 9.

The destination floor buttons 21 and the landing buttons 22 are connected to the over speed monitoring portion 15 without the intervention of the control panel 9. More specifically, a call registration signal from the destination floor buttons 21 and the landing buttons 22 is transmitted to the over speed monitoring portion 15 by a different route from that used for transmission to the control panel 9. The rest of the configuration is other structural components are similar to those of Embodiment 1.

Figure 6:
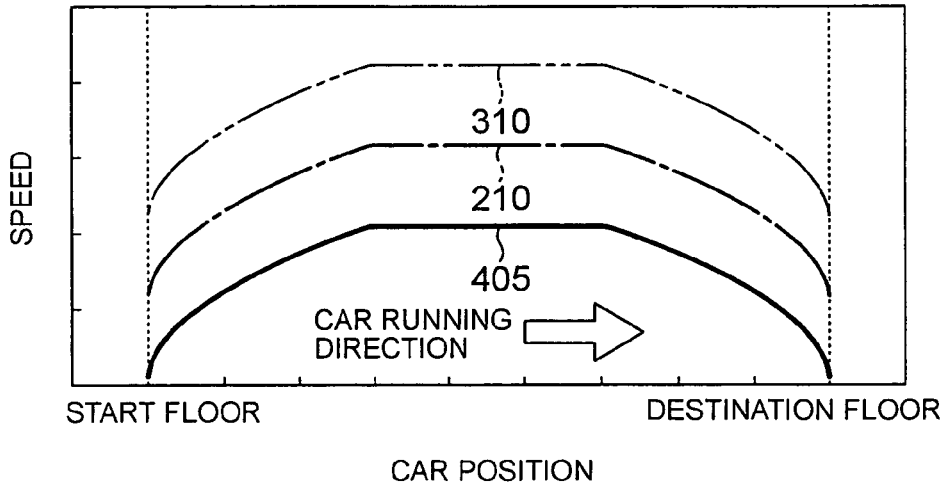
FIG. 6 is a graph illustrating a running speed pattern, a first over speed, and a second over speed obtained when the car shown in FIG. 4 runs normally from a start floor to a destination floor.

Next, a method of setting first and second over speeds in the over speed setting portion 16 of Embodiment 2 is described. FIG. 6 is a graph illustrating the running speed pattern, the first over speed, and the second over speed obtained when the car 6 shown in FIG. 4 runs normally from a start floor to a destination floor.

In the figure, a solid line denotes the maximum values of the running speed pattern. An alternate-long-and-short-dashed line denotes the first over speed. Further, a chain-double-dashed line denotes the second over speed.

In the over speed setting portion 16, the running speed pattern from the start floor to the destination floor is generated based on call registration information obtained from the destination floor buttons 21 and the landing buttons 22. More specifically, in the over speed setting portion 16, a running speed pattern different from the running speed pattern generated by the control panel 9 is independently generated without depending on information from the control panel 9.

The running speed pattern generated by the over speed setting portion 16 is determined using maximum values of speed assumed with regard to each of an acceleration region, a deceleration region, and a constant speed running region. Therefore, when there is no abnormality, the running speed of the car 6 does not exceed the running speed pattern generated by the over speed setting portion 16.

The first over speed is set as a pattern higher than the running speed pattern generated by the over speed setting portion 16, with a certain extent of margin between itself and the running speed pattern. The second over speed is set as a pattern higher than the first over speed with a certain extent of margin between itself and the first over speed. Therefore, the first and the second over speeds do not remain constant, and the first and the second over speeds proximate to the start floor and the destination floor are set to be lower than those of the other portion.

The running speed pattern is generated every time the car 6 runs. Therefore, the first and the second over speeds are also newly generated every time the car 6 runs according to the change in the running speed pattern. When, for example, the destination floor is changed while the car 6 is running, the running speed pattern is adjusted, and the first and second over speeds are also adjusted according to the adjustment.

The over speed monitoring portion 15 is provided with the storage means (memory) and the processing means (CPU). The storage means stores the running speed pattern and the first and second over speed patterns as described in the above. The processing means generates the running speed pattern and sets the first and second over speeds. Further, the processing means determines the first and second over speeds corresponding to the car position information and compares the car speed information with the first and second over speeds.

In such an elevator apparatus, since the over speed setting portion 16 generates the running speed pattern independently of the control panel 9 and sets the first and second over speeds based on the running speed pattern, even when the control panel 9 is out of order, it can be detected more accurately that the running speed of the car 6 reaches the first and second over speeds.

In addition, since the running speed pattern is generated as running speeds obtained when the car 6 runs normally from a start floor to a destination floor and the first and second over speeds are set to be higher than the running speed pattern with a predetermined margin between themselves and the running speed pattern, the first and second over speeds proximate to the start floor and the destination floor are set to be lower than those of the other portion, and thus, an abnormality of the running speed can be detected at an earlier stage.

Further, since the over speed setting portion 16 generates the running speed pattern based on the call registration information from the destination floor buttons 21 and the landing buttons 22, a more accurate running speed pattern can be generated.

Still further, when the destination floor is changed while the car 6 is running, the over speed setting portion 16 adjusts the running speed pattern and the first and second over speeds according to the change of the destination floor. Thus, it can be detected more accurately that the running speed of the car 6 reaches the first and second over speeds.

It should be noted that, in an elevator apparatus where a plurality of cars run in a common hoistway, that is, a system where multiple cars serve on one shaft, the over speed setting portion needs to generate the running speed patterns of the respective cars based on the call registration information of the cars and to set the first and second over speeds.

Although the running speed pattern and the first and second over speed patterns are stored in the storage means in Embodiments 1 and 2, only the running speed pattern may be stored in the storage means, and the first and second over speeds may be determined from the running speed pattern according to the car position information as occasion requires.

Embodiment 3

Figure 7:
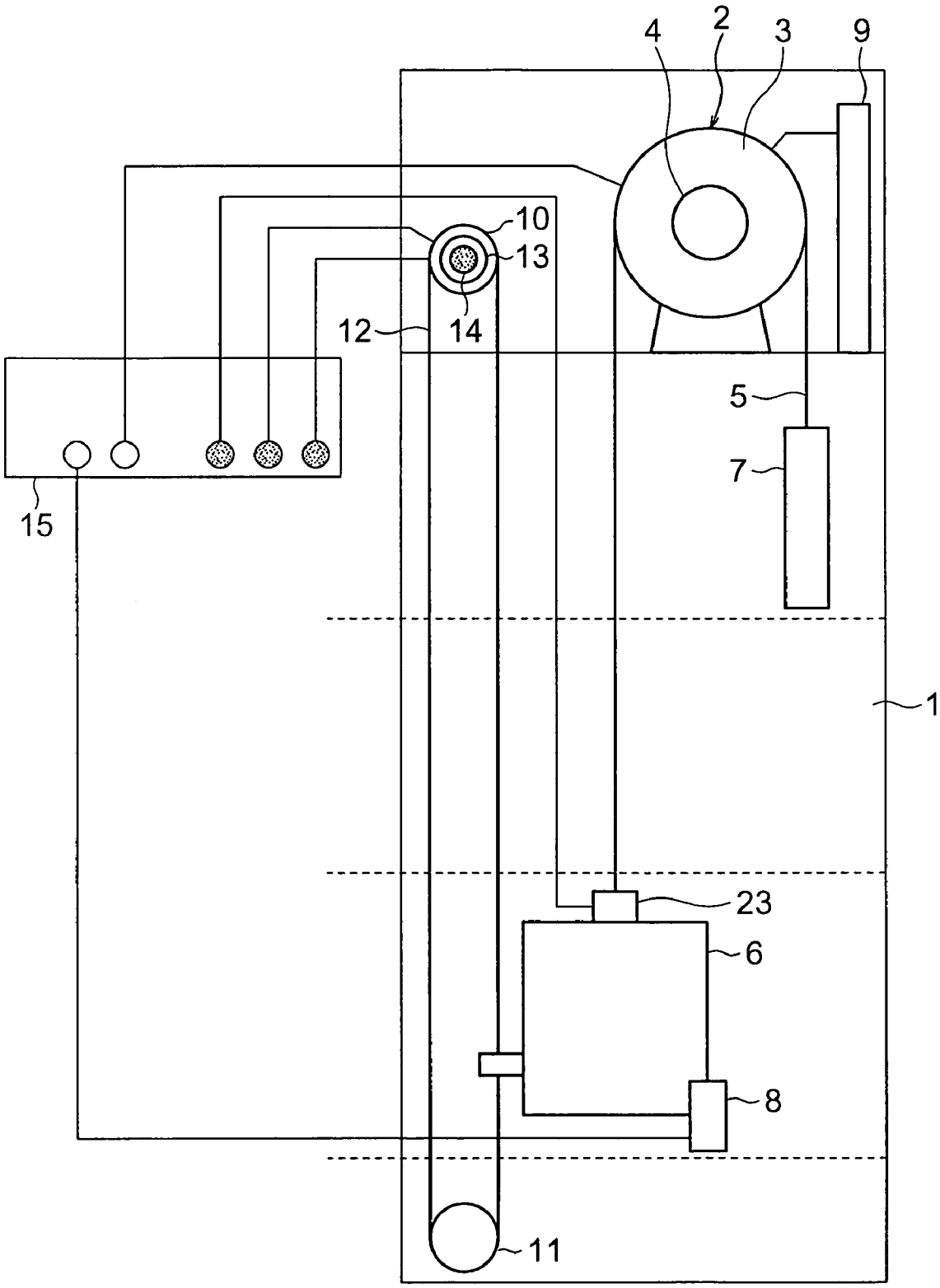
FIG. 7 is a structural diagram illustrating an elevator apparatus according to Embodiment 3 of the present invention.
Figure 8:
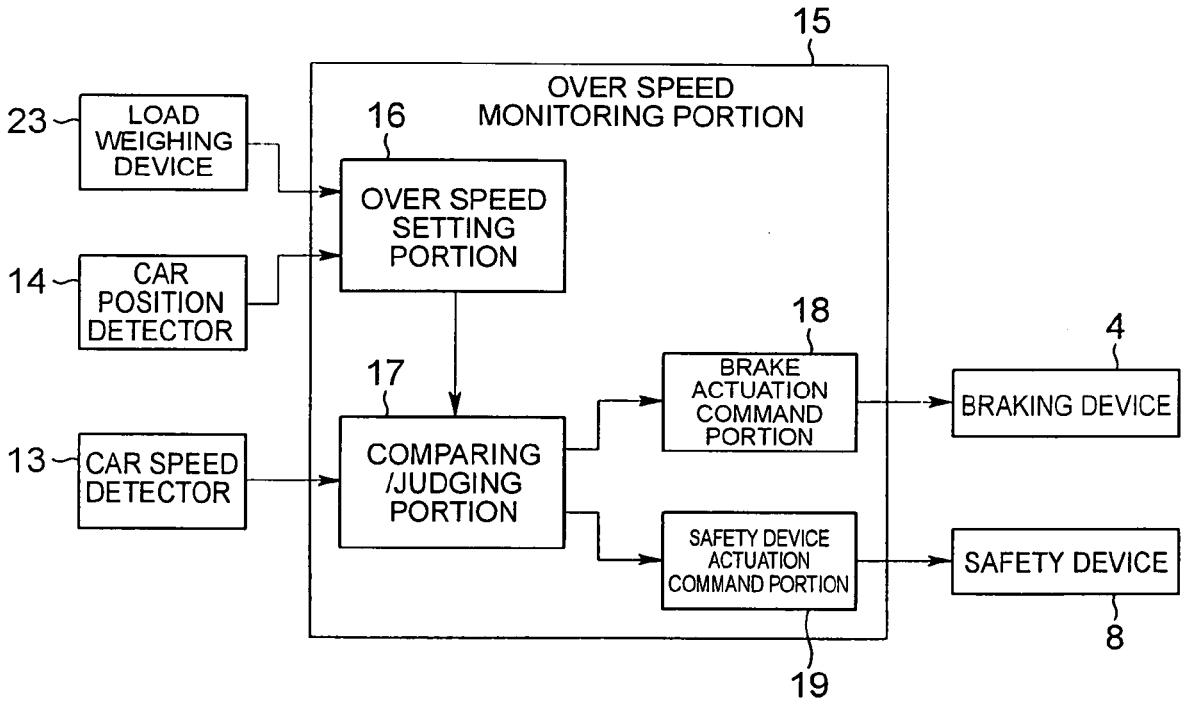
FIG. 8 is a block diagram illustrating main portions of FIG. 7.

Next, FIG. 7 is a structural diagram illustrating an elevator apparatus according to Embodiment 3 of the present invention, and FIG. 8 is a block diagram illustrating main portions of FIG. 7. In the figures, a load weighing device 23 for detecting the weight of a car 6 is provided to a connecting portion of a main rope 5 and the car 6. Car weight information from the load weighing device 23 is transmitted to a control panel 9 and overload of the car 6 is detected.

A running speed pattern generated by the control panel 9 is adjusted based on the car weight information from the load weighing device 23. For example, if the car weight is high, the running speeds in an acceleration region, in a deceleration region, and in a constant speed running region are set to be low. If the car weight is low, the running speeds in the acceleration region, in the deceleration region, and in the constant speed running region are set to be high.

The load weighing device 23 is also connected to the over speed monitoring portion 15 without the intervention of the control panel 9. More specifically, a car weight detection signal from the load weighing device 23 is transmitted to the over speed monitoring portion 15 by a different route from that used for transmission to the control panel 9. The other structural components are similar to those of Embodiment 1.

Next, a method of setting first and second over speeds in an over speed setting portion 16 of Embodiment 3 is described. In the over speed setting portion 16 of Embodiment 3, basically similarly to the case of Embodiment 1, the first and second over speeds are set based on a running speed pattern obtained when the car 6 runs normally from one terminal landing to the other terminal landing. However, in Embodiment 3, the running speed pattern is adjusted according to the car weight information, and the first and second over speeds are also adjusted according to the adjustment to the running speed pattern.

The running speed pattern is adjusted according to the car weight information with regard to each of the acceleration region, the deceleration region, and the constant speed running region. For example, if the car weight is high, the running speeds in the acceleration region, in the deceleration region, and in the constant speed running region are set to be low, and if the car weight is low, the running speeds in the acceleration region, in the deceleration region, and in the constant speed running region are set to be high.

In such an elevator apparatus, since the first and second over speeds are adjusted according to the car, weight information, when the running speed pattern generated by the control panel 9 is changed according to the car weight information, the running speed pattern generated by the over speed setting portion 16 can also be adjusted in a similar way, and more appropriate first and second over speeds can be set.

Embodiment 4

Figure 9:
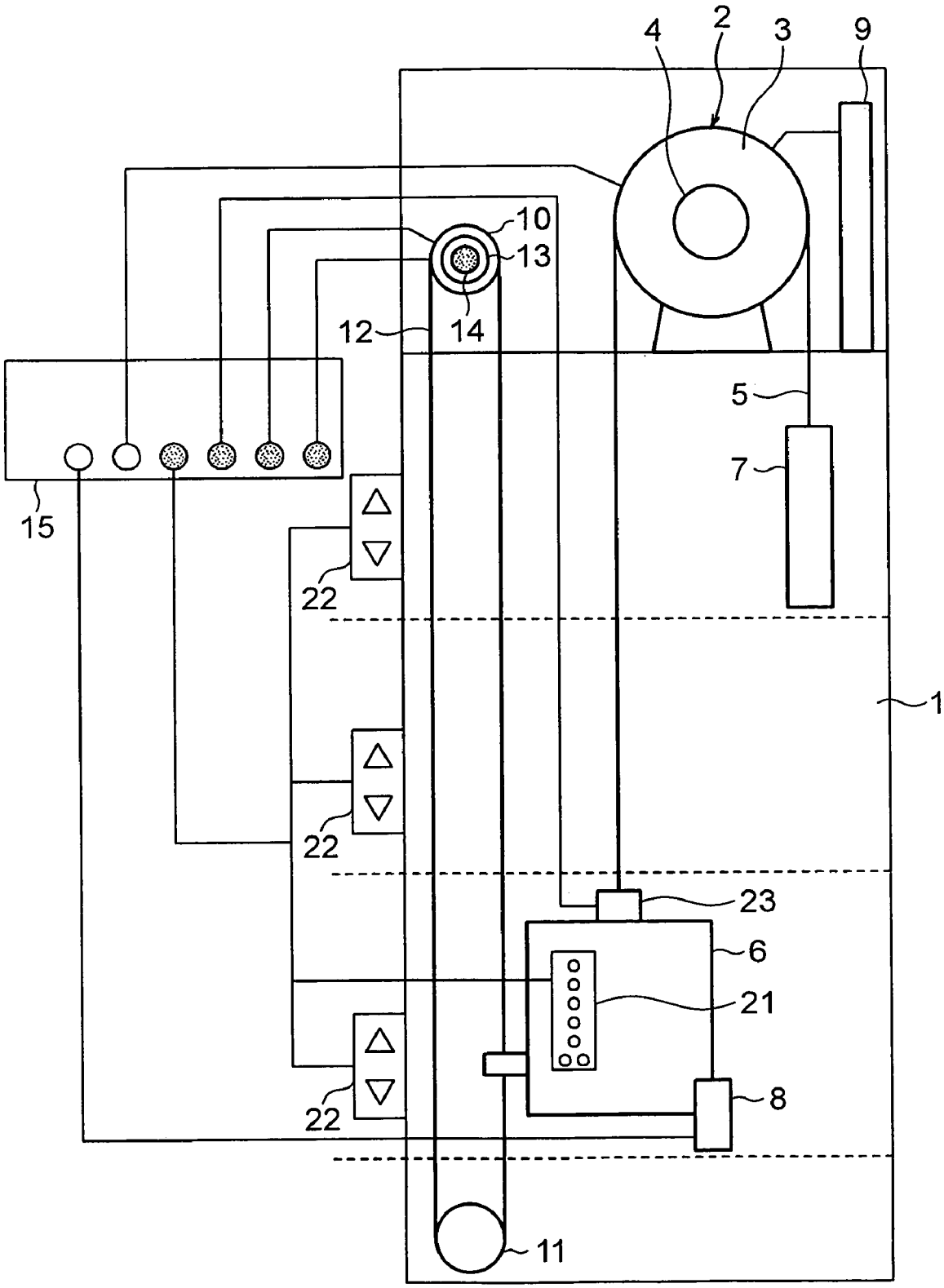
FIG. 9 is a structural diagram illustrating an elevator apparatus according to Embodiment 4 of the present invention.
Figure 10:
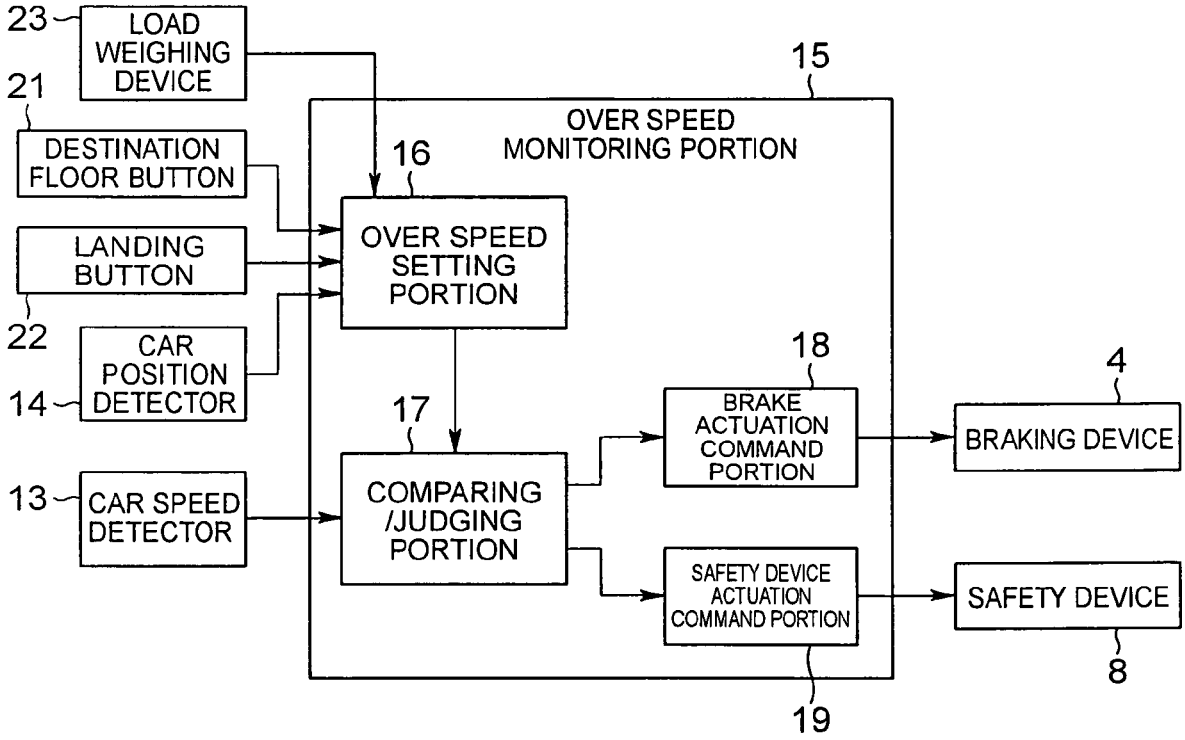
FIG. 10 is a block diagram illustrating main portions of FIG. 9.

Next, FIG. 9 is a structural diagram illustrating an elevator apparatus according to Embodiment 4 of the present invention, and FIG. 10 is a block diagram illustrating main portions of FIG. 9. Embodiment 4 adjusts the running speed pattern described in Embodiment 2 according to the car weight information described in Embodiment 3. More specifically, in Embodiment 4, the running speed pattern from a start floor to a destination floor illustrated in FIG. 6 is adjusted according to the car weight information.

Even with such an elevator apparatus, it can be detected more accurately that the running speed of a car 6 reaches first and second over speeds, and more appropriate first and second over speeds can be set.

It should be noted that, although the running speed pattern is changed according to the car weight information in Embodiments 3 and 4, the first and second over speeds may be directly changed according to the car weight information.

Further, although the load weighing device 23 described in Embodiments 3 and 4 is of a type which is provided to the connecting portion of the main rope 5 and the car 6, the load weighing device may be of another type, for example, of a type which is provided at a car platform.

Embodiment 5

Figure 11:
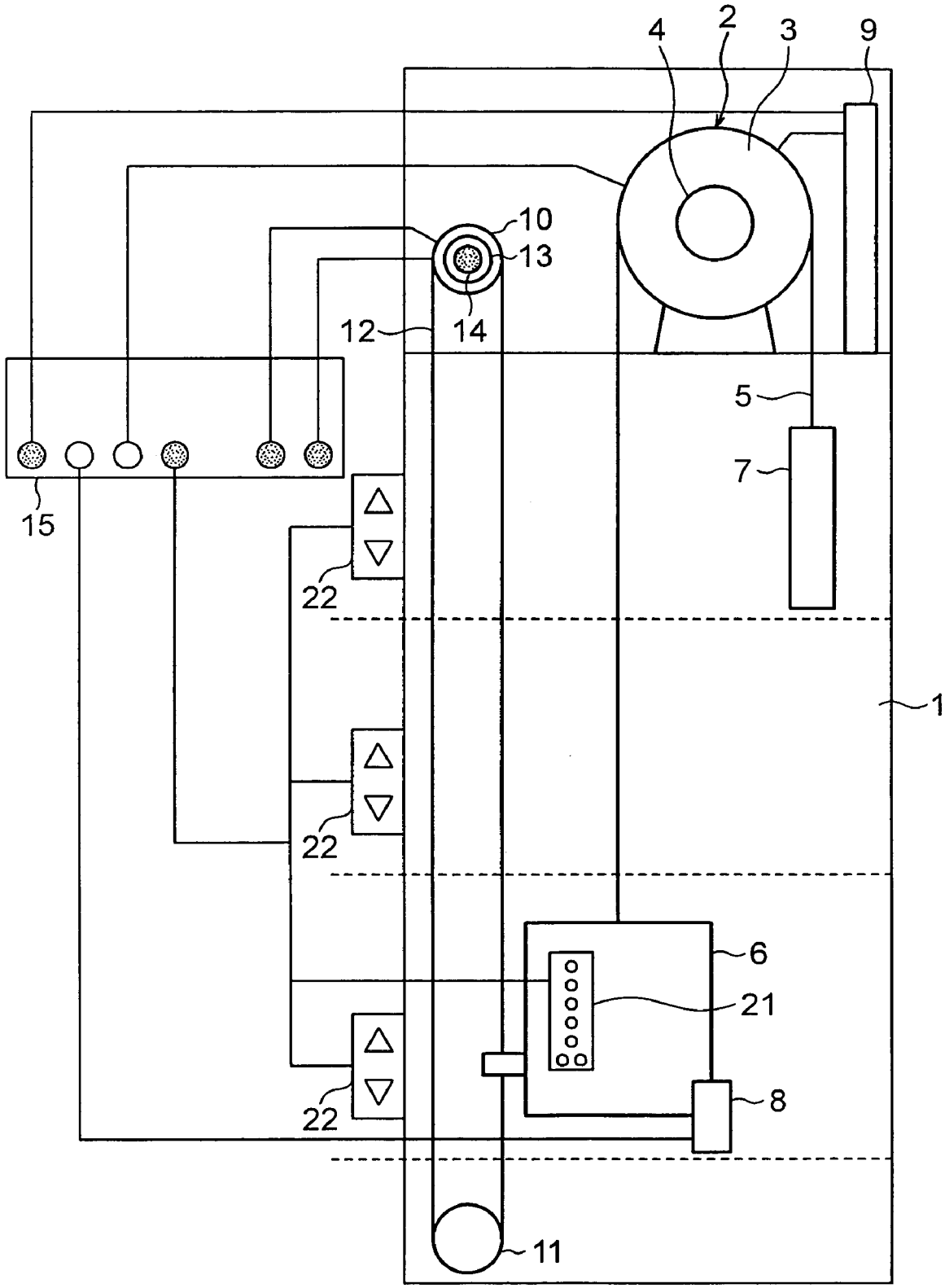
FIG. 11 is a structural diagram illustrating an elevator apparatus according to Embodiment 5 of the present invention.
Figure 12:
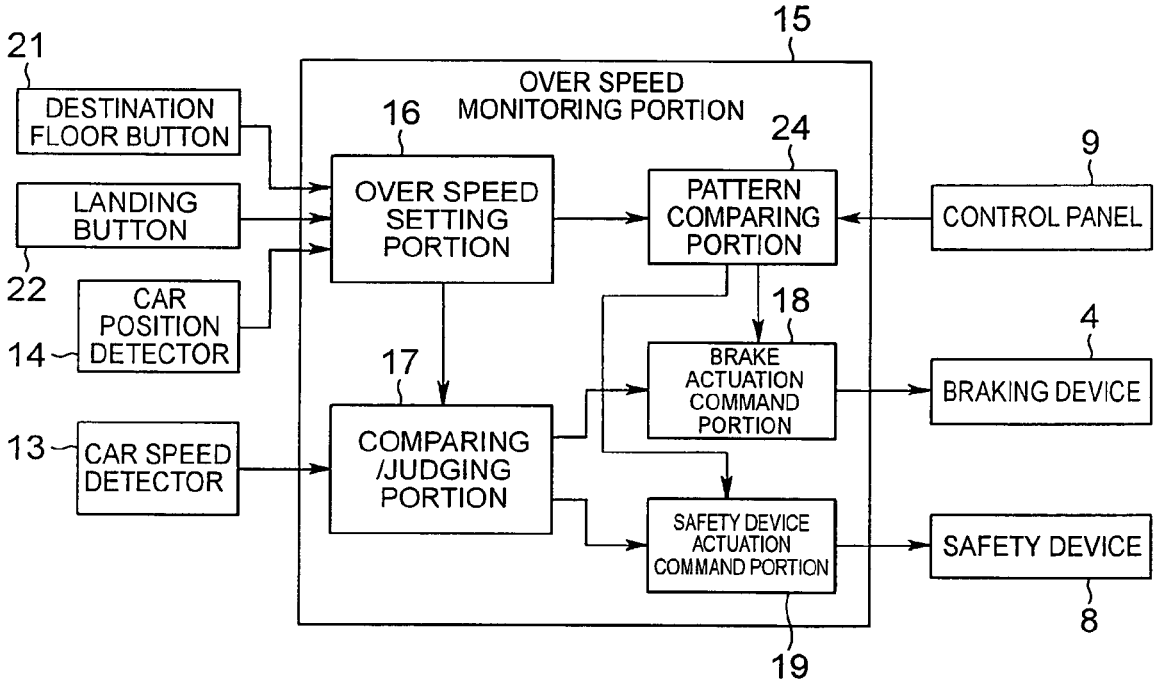
FIG. 12 is a block diagram illustrating main portions of FIG. 11.

Next, FIG. 11 is a structural diagram illustrating an elevator apparatus according to Embodiment 5 of the present invention, and FIG. 12 is a block diagram illustrating main portions of FIG. 11. In the figures, information of a running speed pattern generated by a control panel 9 is transmitted to the over speed monitoring portion 15. The over speed monitoring portion 15 has a pattern comparing portion 24 for comparing a running speed pattern generated by the over speed setting portion 16 with the running speed pattern generated by the control panel 9.

When the difference between the two running speed patterns is equal to or more than a preset value, the pattern comparing portion 24 outputs a command signal to at least one of the brake actuation command portion 18 and the safety device actuation command portion 19, and actuates at least one of the braking device 4 and the safety device 8. The other structural components are similar to those of Embodiment 2.

In such an elevator apparatus, since the pattern comparing portion 24 for comparing the running speed pattern generated by the over speed setting portion 16 with the running speed pattern generated by the control panel 9 is used, it can be monitored whether there is an abnormality of the over speed monitoring portion 15 and of the control panel 9, and the reliability can be improved.

Embodiment 6

Figure 13:
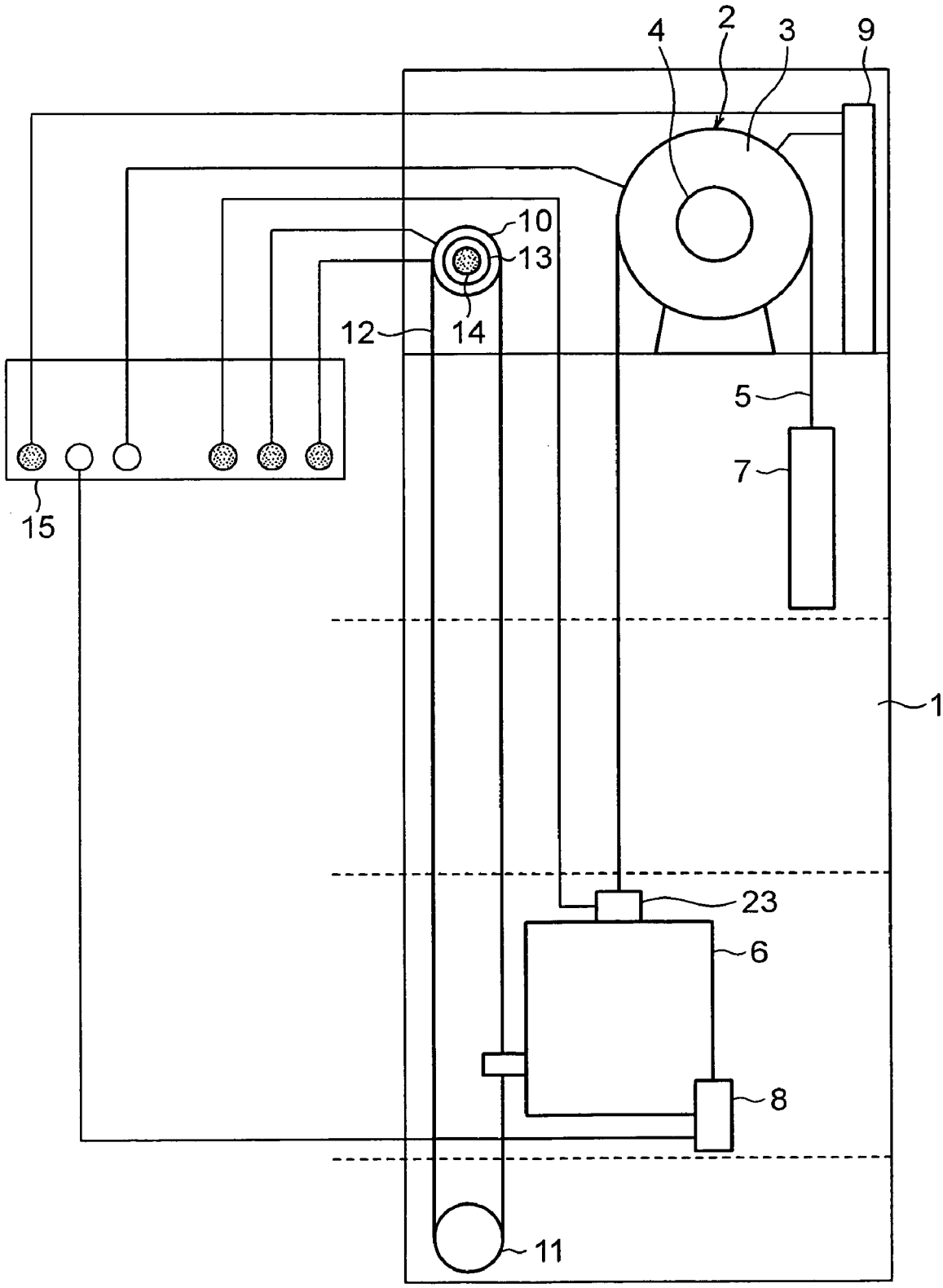
FIG. 13 is a structural diagram illustrating an elevator apparatus according to Embodiment 6 of the present invention.
Figure 14:
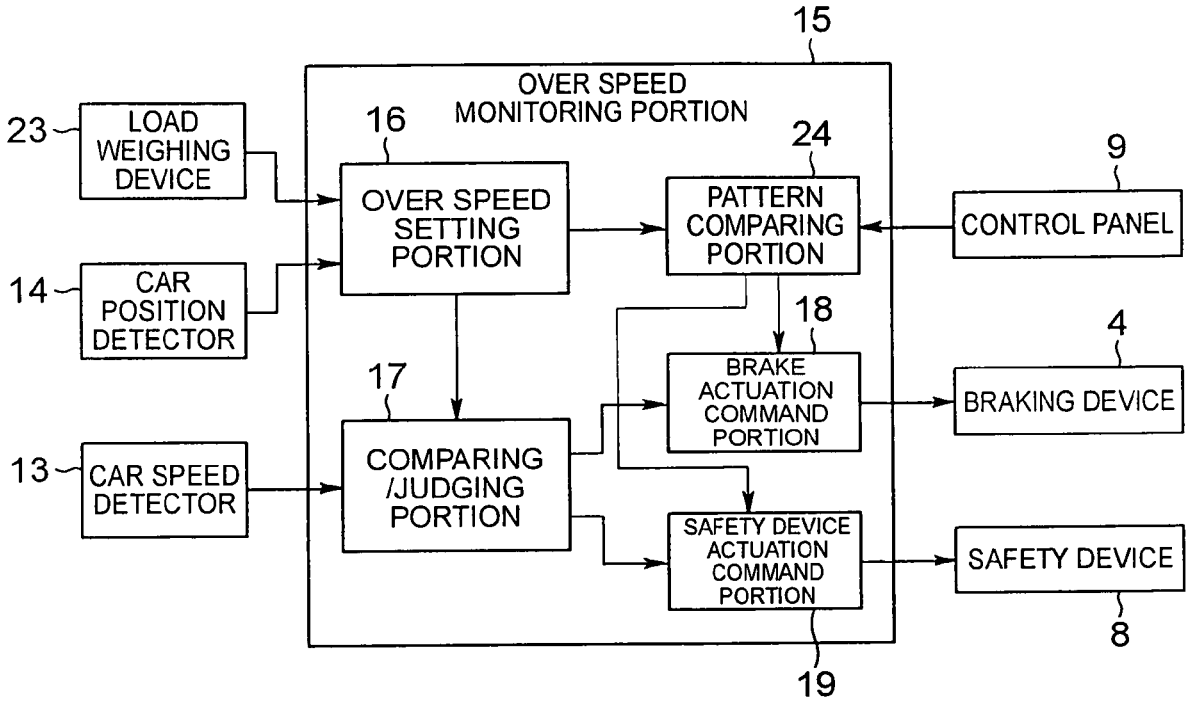
FIG. 14 is a block diagram illustrating main portions of FIG. 13.

Next, FIG. 13 is a structural diagram illustrating an elevator apparatus according to Embodiment 6 of the present invention, and FIG. 14 is a block diagram illustrating main portions of FIG. 13. In the figures, information of a running speed pattern generated by a control panel 9 is transmitted to the over speed monitoring portion 15. The over speed monitoring portion 15 has a pattern comparing portion 24 for comparing a running speed pattern used by the over speed monitoring portion 15 with the running speed pattern generated by the control panel 9.

When the difference between the two running speed patterns is equal to or more than a preset value, the pattern comparing portion 24 outputs a command signal to at least one of the brake actuation command portion 18 and the safety device actuation command portion 19, and actuates at least one of the braking device 4 and the safety device 8. The other structural components are similar to those of Embodiment 3.

In such an elevator apparatus, since the pattern comparing portion 24 for comparing the running speed pattern used by the over speed monitoring portion 15 (running speed pattern adjusted according to car weight information) with the running speed pattern generated by the control panel 9 is used, it can be monitored whether there is an abnormality of the over speed monitoring portion 15 and of the control panel 9, and the reliability can be improved.

Embodiment 7

Figure 15:
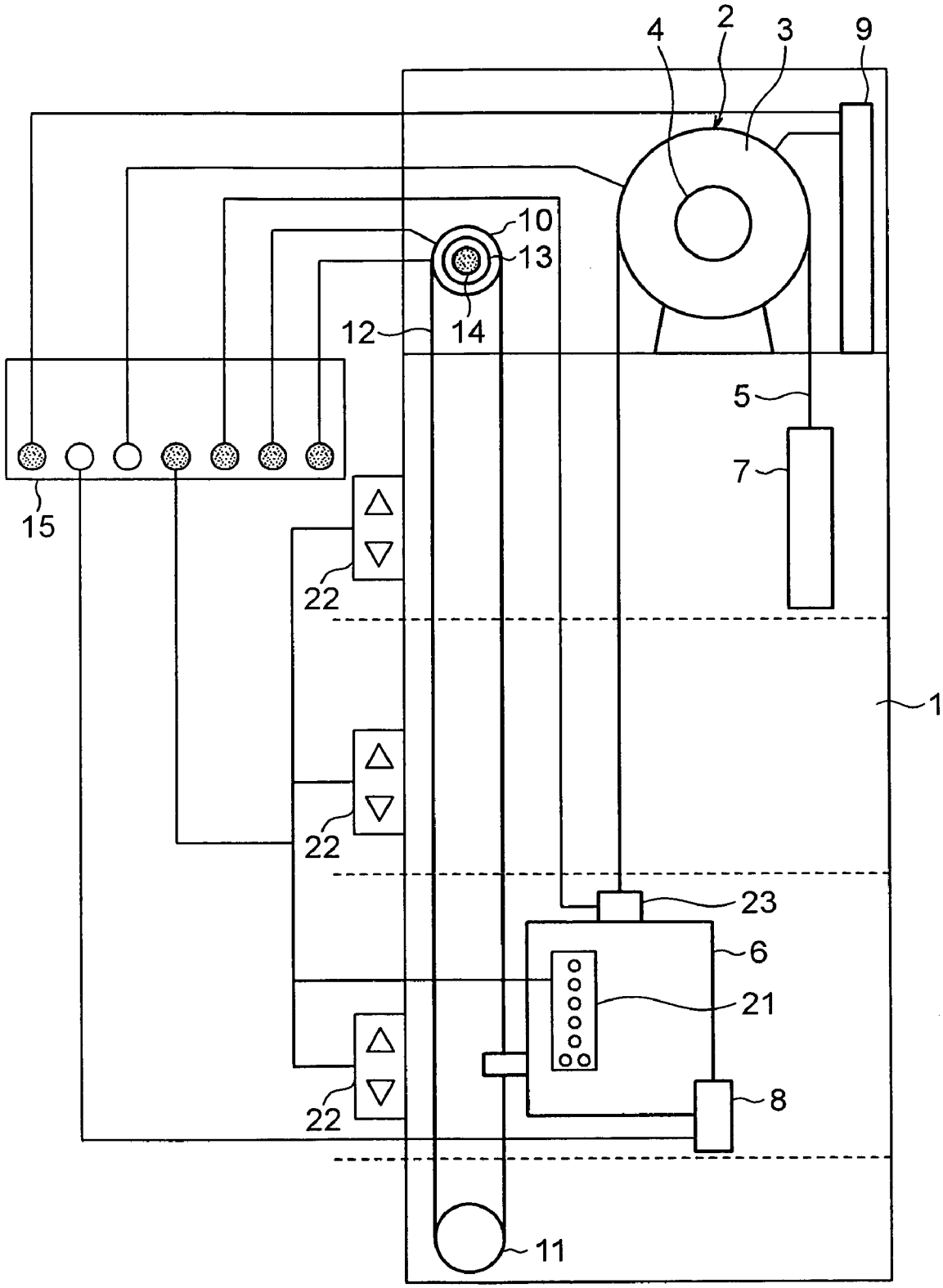
FIG. 15 is a structural diagram illustrating an elevator apparatus according to Embodiment 7 of the present invention.
Figure 16:
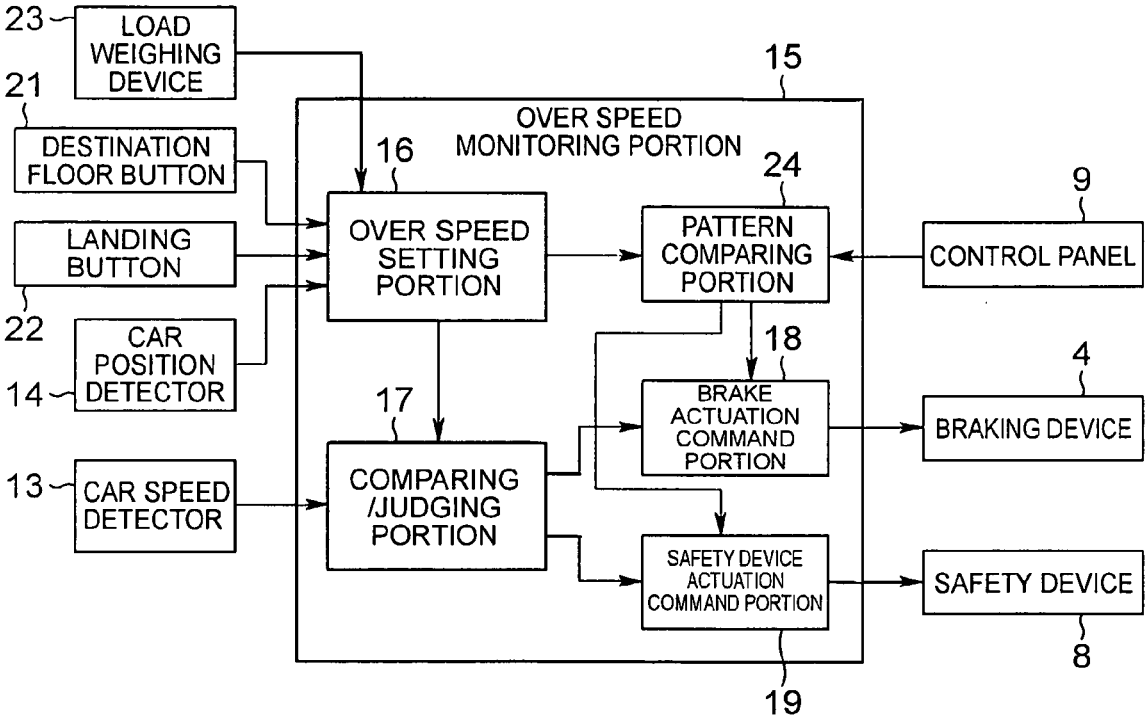
FIG. 16 is a block diagram illustrating main portions of FIG. 15.

Next, FIG. 15 is a structural diagram illustrating an elevator apparatus according to Embodiment 7 of the present invention, and FIG. 16 is a block diagram illustrating main portions of FIG. 15. In the figures, information of a running speed pattern generated by a control panel 9 is transmitted to an over speed monitoring portion 16. The over speed monitoring portion 15 has a pattern comparing portion 24 for comparing a running speed pattern generated by the over speed setting portion 16 with the running speed pattern generated by the control panel 9.

When the difference between the two running speed patterns is equal to or more than a preset value, the pattern comparing portion 24 outputs a command signal to at least one of the brake actuation command portion 18 and the safety device actuation command portion 19, and actuates at least one of the braking device 4 and the safety device 8. The other structural components are similar to those of Embodiment 4.

In such an elevator apparatus, since the pattern comparing portion 24 for comparing the running speed pattern generated by the over speed setting portion 16 with the running speed pattern generated by the control panel 9 is used, it can be monitored whether there is an abnormality of the over speed monitoring portion 15 and of the control panel 9, and the reliability can be improved.

It should be noted that the two running speed patterns are directly compared in Embodiments 5 to 7, but may be indirectly compared. For example, the first and second over speeds may be determined from the running speed pattern generated by the control panel 9 and may be compared with first and second over speeds set by the over speed monitoring portion 15.

Further, the car speed detector and the car position detector are not limited to particular ones, and an encoder, for example, may be used. Also, the car position and the car speed may be measured by, for example, the reflection of detecting light.

Further, the braking means is not limited to the braking device 4 and the safety device 8, and may be, for example, a rope brake for clamping the main rope 5.

Still further, the mechanical structure of the safety device is not limited to a particular one, and every type of safety device may be used.

Further, the first and second over speeds are set in Embodiments 1 to 7, the over speed monitoring portion may set only one over speed or may set three or more over speeds.

Further, the place where the over speed monitoring portion is provided is not limited to a particular place, and the over speed monitoring portion may be provided in the hoistway, in a machine room, or above the car, for example.

Still further, although the over speeds are set to continuously change according to the running pattern in FIGS. 3 and 6, the over speeds may be set to change stepwise.

Further, although the cases where the over speed monitoring portion independent of the controller adjusts the over speeds according to the car weight information are described in the above, the adjustment of the over speeds may be made by an over speed monitoring portion which depends on the controller according to the car weight information.

The invention claimed is:

1. An elevator apparatus, comprising:

a car for ascending and descending in a hoistway;

a controller for controlling the ascending and descending of the car;

braking means for braking the car;

a car speed detector for detecting a running speed of the car;

a car position detector for detecting a position of the car; and an over speed monitoring portion for receiving information from the car speed detector and the car position detector, comparing an over speed set correspondingly to the position of the car with the running speed of the car, and actuating the braking means when the running speed of the car reaches the over speed, wherein the over speed monitoring portion sets the over speed independently of the controller.

2. The elevator apparatus as claimed in claim 1, wherein the over speed monitoring portion sets the over speed based on the running speed pattern of the car generated independently of the controller.

3. The elevator apparatus as claimed in claim 2, wherein the over speed monitoring portion sets the over speed to be higher than a running speed pattern obtained when the car runs normally from one terminal landing to the other terminal landing.

4. The elevator apparatus as claimed in claim 2, wherein the over speed monitoring portion generates a running speed pattern when the car runs normally from a start floor to a destination floor, and sets the over speed so as to be higher than the running speed pattern.

5. The elevator apparatus as claimed in claim 4, wherein when the destination floor is changed while the car is running, the over speed monitoring portion adjusts the running speed pattern and the over speed according to the change of the destination floor.

6. The elevator apparatus as claimed in claim 4, further comprising:

destination floor buttons provided to the car; and landing buttons provided to landings, wherein the over speed monitoring portion generates the running speed pattern based on call registration information obtained from at lest one of the destination floor buttons and the landing buttons.

7. The elevator apparatus as claimed in claim 1, further comprising a load weighing device for detecting a weight of the car, wherein the over speed monitoring portion adjusts the over speed according to car weight information obtained from the load weighing device.

8. The elevator apparatus as claimed in claim 2, wherein:

the controller generates the running speed pattern of the car; and the over speed monitoring portion compares the running speed pattern generated by the controller with the running speed pattern used by the over speed monitoring portion, and when a difference between the two running speed patterns is equal to or more than a preset value, actuates the braking means.

9. An elevator apparatus, comprising:

a car for ascending and descending in a hoistway;

braking means for braking the car;

a car speed detector for detecting a running speed of the car;

a load weighing device for detecting a weight of the car; and an over speed monitoring portion for receiving information from the car speed detector, comparing a set over speed with the running speed of the car, and actuating the braking means when the running speed of the car reaches the over speed, wherein the over speed monitoring portion adjusts the over speed according to car weight information obtained from the load weighing device.

* * * * *